US011024975B2

(12) United States Patent
Rowell et al.

(10) Patent No.: US 11,024,975 B2
(45) Date of Patent: Jun. 1, 2021

(54) MULTI-BAND ORTHOMODE TRANSDUCER DEVICE

(71) Applicant: Rohde & Schwarz GmbH & Co. KG, Munich (DE)

(72) Inventors: Corbett Rowell, Munich (DE); Christian Riedel, Munich (DE)

(73) Assignee: Rohde & Schwarz GmbH Co. KG, Munich (DE)

( * ) Notice: Subject to any disclaimer, the term of this patent is extended or adjusted under 35 U.S.C. 154(b) by 0 days.

(21) Appl. No.: 16/445,520

(22) Filed: Jun. 19, 2019

(65) Prior Publication Data

US 2020/0403319 A1 Dec. 24, 2020

(51) Int. Cl.

| | |
|---|---|
| ***H01Q 13/02*** | (2006.01) |
| ***H01P 1/213*** | (2006.01) |
| ***H01Q 1/42*** | (2006.01) |
| ***H01P 1/161*** | (2006.01) |

(52) U.S. Cl.
CPC ..... *H01Q 13/0258* (2013.01); *H01P 1/161* (2013.01); *H01P 1/2131* (2013.01); *H01Q 1/42* (2013.01)

(58) Field of Classification Search
CPC ... H01P 1/2131; H01P 1/161; H01Q 13/0258; H01Q 1/42
See application file for complete search history.

(56) References Cited

U.S. PATENT DOCUMENTS 7,623,084 B2 * 11/2009 Hoferer ..... H01P 1/161 343/776

FOREIGN PATENT DOCUMENTS

EP 1543579 A1 3/2007

* cited by examiner

*Primary Examiner* — Robert J Pascal
*Assistant Examiner* — Kimberly E Glenn
(74) *Attorney, Agent, or Firm* — Schwabe, Williamson & Wyatt, P.C.

(57) ABSTRACT

A multi-band orthomode transducer device comprises a three-dimensional housing. The three-dimensional housing encompasses at least two orthomode transducers, each orthomode transducer being assigned to three ports of which a first port relates to a first polarization, a second port relates to a second polarization and a third port relates to a combination of the first and second polarizations. Each of the orthomode transducers has a waveguide connected with the three ports. The waveguides of the orthomode transducers are located in the three-dimensional housing without intersecting each other.

18 Claims, 1 Drawing Sheet

MULTI-BAND ORTHOMODE TRANSDUCER DEVICE

FIELD OF THE DISCLOSURE

Embodiments of the present disclosure relates to a multi-band orthomode transducer device.

BACKGROUND

Modern communication systems comprise devices that communicate over-the-air, for instance via satellites. The respective devices may comprise dual-polarized antennas, for instance horn antennas, which are connected with waveguides in order to process the respective signals.

Those antennas require orthomode transducers (OMTs), corresponding to waveguide components, are used either to combine or to separate two orthogonally polarized signal portions of the respective signals. In other words, the orthomode transducers overlay or rather separate two orthogonal modes, for instance a horizontally polarized mode and a vertically polarized mode, onto the same waveguide.

Even though the dual-polarized antennas combined with the orthomode transducers have good performance characteristics such as a stable half-power beamwidth (HPBW) and phase center, the respective bandwidth is limited due to constraints of the waveguide physics, namely cut-off and higher-order modes, or due to directivity/HPBW changing significantly with frequency. However, the signals used may have a large bandwidth. Thus, several orthomode transducers with orthogonally polarized antennas assigned thereto have to be used in order to measure several different frequencies, which results in complex systems. Further, this yields problems in an automated system for feed switching while leading to cable-bending or very large energy chains.

Accordingly, there is a need for a possibility to measure several different frequencies in an easy and efficient manner.

SUMMARY

Embodiments of the present disclosure provide a multi-band orthomode transducer device with a three-dimensional housing, the three-dimensional housing encompassing at least two orthomode transducers. Each orthomode transducer is assigned to three ports of which a first port is assigned to a first polarization, a second port is assigned to a second polarization and a third port is assigned to a combination of the first and second polarizations. Each of the orthomode transducers has a waveguide connected with the three ports. The waveguides of the orthomode transducers are located in the three-dimensional housing without intersecting each other.

Accordingly, a compact multi-band orthomode transducer device is provided that has two or more orthomode transducers, for instance three orthomode transducers, housed in a common three-dimensional housing. In other words, the orthomode transducers are integrated in the single three-dimensional housing of the multi-band orthomode transducer device.

The first and the second polarizations may be orthogonal with respect to each other. Thus, each orthomode transducer of the multi-band orthomode transducer device may split a respective signal received into two components that are polarized orthogonally with respect to each other.

As the orthomode transducers are located within the three-dimensional housing without intersecting each other, the signals or rather signal portions processed by the orthomode transducers do not interfere with each other. Accordingly, each orthomode transducer can be assigned to a respective frequency range (frequency band) of the entire bandwidth covered by the multiple-band orthomode transducer device. In fact, no internal intersection of the waveguides occur within the multi-band orthomode transducer device, particularly its housing. In other words, the orthomode transducer device is a multi-band orthomode transducer device, as the several orthomode transducers located within the three-dimensional housing are assigned to a respective separate frequency band resulting in several separate frequency bands that can be processed by the single multi-band orthomode transducer device.

According to an aspect, the first port relates to a first output port and the second port relates to a second output port. The third port of each orthomode transducer may relate to a feed port via which randomly polarized signals may be fed to the respective orthomode transducer, which splits the respective signals into two signal portions with different polarizations, which are forwarded to the first port and the second port, respectively. Hence, each orthomode transducer outputs via its output ports the respective split signal portions that are polarized orthogonally with respect to each other.

Alternatively, the first port relates to a first feed port and the second port relates to a second feed port. The third port of each orthomode transducer may relate to a single output port. Hence, differently polarized, particularly orthogonally polarized, signals are combined by each orthomode transducer such that the combined signal obtained can be outputted via the third port, namely the single output port.

Another aspect provides that the first port of each orthomode transducer is opposite to the respective third port. Thus, the respective waveguide of each orthomode transducer runs between the first and the third ports in a straight manner, as the respective ports are located opposite to each other. In fact, the waveguide located between the respective first and third ports comprises at least a straight line portion.

Further, the respective first ports may be located in different planes being parallel to a base area of the multi-band orthomode transducer device, particularly the housing. In other words, the respective first ports are located in different heights with respect to the ground of the multi-band orthomode transducer device. This arrangement of the respective first ports also ensures that the respective waveguides of the orthomode transducer do not intersect with each other.

As the respective first ports are located in different planes and the third ports are opposite to the respective first ports, the third ports are also located in different planes that are parallel to the base area of the multi-band orthomode transducer device. In fact, the first ports and the third ports of each orthomode transducer are located in the same plane being parallel to the base area.

In addition, the respective second ports are located at a common side of the three-dimensional housing. Thus, the second ports of the different orthomode transducers are located at the same side of the three-dimensional housing so that the second ports can be connected easily, namely via a common side of the multi-band orthomode transducer device.

According to another aspect, the respective second ports are located in a common plane being parallel to a base area of the multi-band orthomode transducer device. The respective common plane may be opposite to the base area of the multi-band orthomode transducer device. In other words, the common plane corresponds to the top plane of the three-dimensional housing that is opposite to the base area of the housing. However, the second ports may also be located at the base area, namely the respective base surface of the housing, as the base area is parallel to itself.

The first ports may be perpendicularly orientated with respect to the second ports. Hence, the first ports (as well as the third ports) may be located at sides that are perpendicular with respect to the common side at which the respective second ports are located. As the second ports may be located at the top of the three-dimensional housing, the first ports (as well as the third ports) may be located at face sides or rather lateral side(s) of the respective three-dimensional housing.

As mentioned above, the first and second ports are assigned to different polarized signals, particularly orthogonally polarized signals. Hence, the first and second ports are orientated orthogonally with respect to each other in order to simplify combination or rather separation of the respective signals or rather signal portions.

According to an embodiment, the first and second ports each are shaped rectangularly. Thus, rectangular waveguides may be connected with the first and second ports. Via the first and second ports, the respective signals polarized orthogonally with respect to each other may be forwarded to or rather received from a network processing the respective signals.

Another aspect provides that the third ports are shaped circularly. Hence, antennas or other structures with circular interfaces may be connected with the third ports. For instance, horn antennas may be connected with the third ports or coaxial structures.

Hence, an integrated rectangular to circular transition is provided, as the third ports are shaped circularly, whereas the first and second ports are shaped rectangularly. The respective rectangular to circular transition may be established by the respective waveguide of the orthomode transducers, particularly the interfaces merging into the respective ports.

Generally, a network may provide orthogonally polarized signals processed via the first and second ports of the respective orthomode transducer in order to combine the orthogonally polarized signals resulting in a combined signal outputted via the third port of the orthomode transducer.

Alternatively or additionally, namely in another operation mode, signals are received via the third port, which are split by the respective orthomode transducer in order to separate the respective signals in orthogonally polarized signals forwarded to the network via the first and second ports.

According to another aspect, the at least two orthomode transducers are assigned to separate frequency bands. Thus, the multi-band orthomode transducer device is established, as each of the orthomode transducers is assigned to a certain frequency band.

For instance, the separate frequency bands together range from 20 to 90 GHz. A first frequency band may range from 20 to 40 GHz, a second frequency band may range from 40 to 60 GHz and a third frequency band may range from 60 to 90 GHz. Hence three orthomode transducers are provided, which are assigned to the respective frequency bands.

Another aspect provides that at least one of the rotary positioner, a multiplexer and a switch is provided. Hence, the entire multi-band orthomode transducer device with the integrated orthomode transducers may be rotated to cover the different frequency bands.

Further, a multiplexer, particularly a waveguide multiplexer, and/or a switch may be provided in order to switch to and fro the respective orthomode transducers, particularly the respective waveguides of the orthomode transducers. Hence, it can be ensured that only one of the several orthomode transducers is active while the others are deactivated.

Another aspect provides that an antenna is connected to each of the third ports. Hence, signals may be received via the respective antenna connected to the third port of each orthomode transducer. Alternatively, signals may be transmitted via the respective antenna wherein the signals are based on signals fed into the respective first and second ports of each orthomode transducer.

For instance, the respective antenna is a horn antenna. The horn antenna is a dual-polarized antenna ensuring to emit signals with two different polarizations, namely orthogonal polarizations.

Generally, the multi-band orthomode transducer device may be single-housed. This means that the several orthomode transducers of the multi-band orthomode transducer device are encompassed within the single three-dimensional housing. Thus, moving or rather rotating the multi-band orthomode transducer device results in a respective movement or rather rotation of the integrated orthomode transducers. The single-housed orthomode transducer device is a single unit.

The three-dimensional housing may have a polygonal shape, a cylindrical shape or a spherical shape. The polygonal shape might relate to a three-dimensional body having a square base area, a pentagon base area or a hexagon base area. Depending on the number of orthomode transducers integrated in the multi-band orthomode transducer device, the housing may have a certain shape.

Generally, the respective ports are located at the outer surface(s) of the three-dimensional housing. The waveguides of the orthomode transducers are fully integrated in the housing, wherein the waveguides are connected with the corresponding ports positioned at the outer surface(s) of the housing.

According to an embodiment, the multi-band orthomode transducer device comprises three orthomode transducers integrated in the three-dimensional housing, each orthomode transducer having three different ports, namely a first port, a second port and a third port.

The base area and/or the top area may relate to a flat outer surface of the housing.

The first and second ports of each orthomode transducer may be located in recesses of the respective side, for instance the lateral side. The recesses may extend over the entire side, namely the lateral side. Hence, the recesses reach from the top area to the base area.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
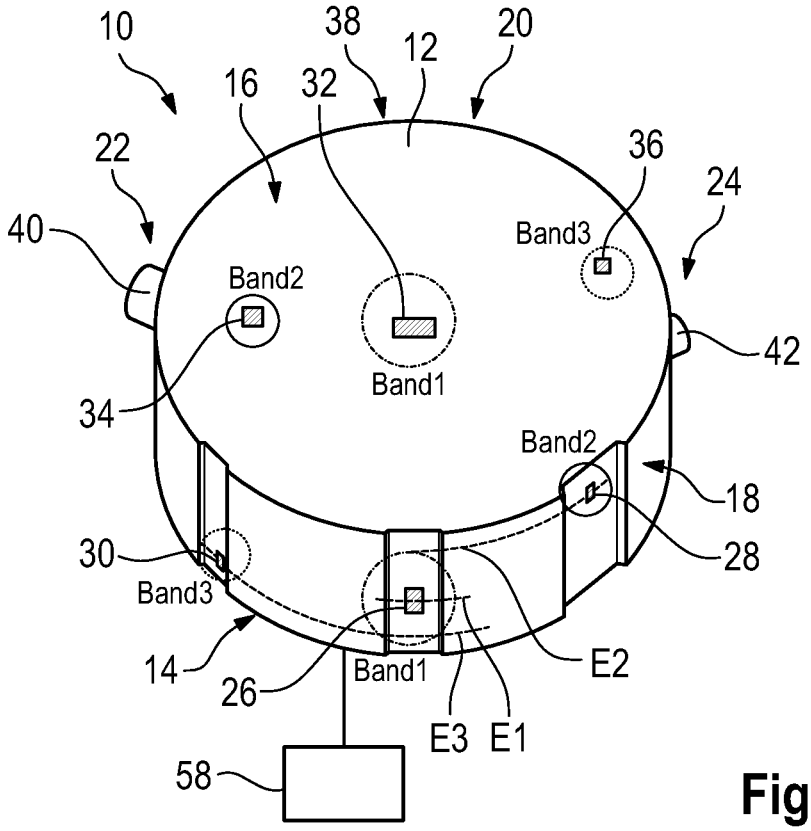
FIG. 1 shows a multi-band orthomode transducer device according to the present disclosure.

FIG. 1 shows schematically a multi-band orthomode transducer device 10 that has a three-dimensional housing 12 with a cylindrical shape. Thus, the housing 12 comprises a substantially disk-shaped base area 14 as well as a substantially disk-shaped top area 16 that is opposite to the base area 14. The base area 14 and the top area 16 are parallel with respect to each other.

Further, the base area 14 and the top area 16 are connected with each other by a lateral surface 18, namely a circular shaped lateral surface, that is perpendicular to the base area 14 as well as the top area 16.

In the shown embodiment, the multi-band orthomode transducer device 10 comprises three orthomode transducers 20, 22, 24 that are integrated in the common three-dimensional housing 12.

Each of the orthomode transducers 20 to 24 comprise a respective first port 26, 28, 30, which can be used as a respective first output port of the respective orthomode transducer 20 to 24. Further, each of the orthomode transducers 20 to 24 comprises a second port 32, 34, 36, which can be used as a second output port of the respective orthomode transducer 20 to 24.

Besides the first and second ports 26 to 36, each of the orthomode transducers 20 to 24 comprises a third port 38, 40, 42, which can be used as a feed port of the respective orthomode transducers 20 to 24.

Accordingly, signals may be received via the third ports 38 to 42 which are processed by the respective orthomode transducers 20 to 24 resulting in differently polarized signals or rather signal portions, also called component signals, forwarded to the first and second ports 26 to 36 of the respective orthomode transducers 20 to 24. Hence, the signal received may be split with respect to its polarization components.

Alternatively, signals are fed to the first and second ports 26 to 36 of the respective orthomode transducers 20 to 24, which are combined to a combined signal outputted via the respective third port 38 to 42 of the orthomode transducers 20 to 24. Accordingly, the third ports 38 to 42 may be used as output port, whereas the first and second ports 26 to 36 relate to feed ports.

Figure 2:
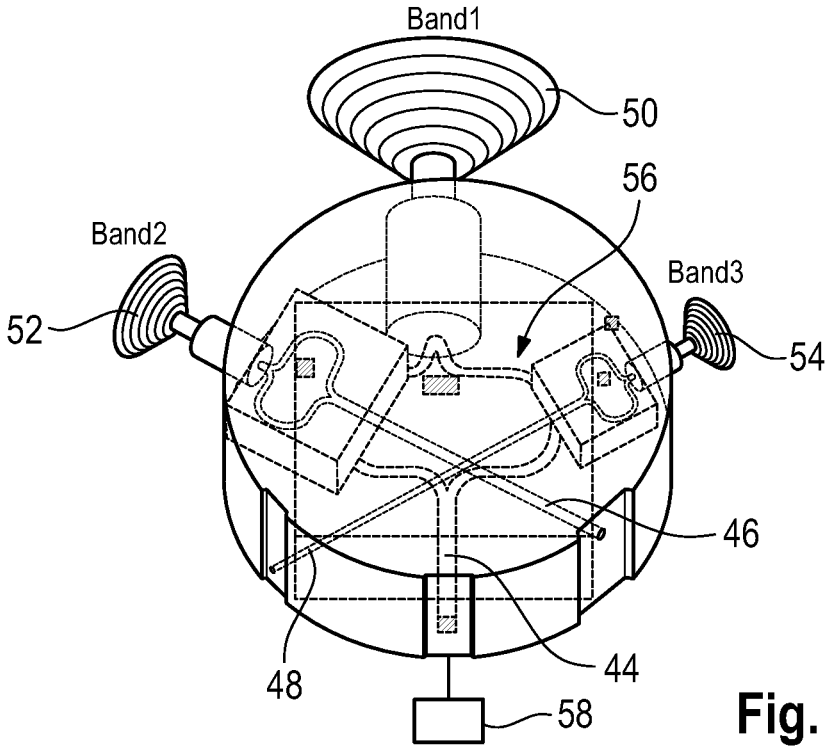
FIG. 2 shows a multi-band orthomode transducer device of FIG. 1 in a partly transparent manner.

As shown in FIGS. 1 and 2, the first ports 26 to 30 of each orthomode transducer 20 to 24 are located opposite to the respective third ports 38 to 42.

Further, the first ports 26 to 30 are located in different planes E1, E2, E3 which are parallel to the base area 14 or rather the top area 16. In other words, the first ports 26 to 30 of the orthomode transducer 20 to 24 are positioned at different heights.

Since the first ports 26 to 30 of each orthomode transducer 20 to 24 are located opposite to the respective third ports 38 to 42, the third ports 38 to 42 are also located in the different planes E1, E2, E3. In other words, the first ports 26 to 30 and the third ports 38 to 42 of the respective orthomode transducer 20 to 24 are located in a common plane.

The first ports 26 to 30 as well as the third ports 38 to 42 are located at the lateral surface 18, whereas the second ports 32 to 36 of each orthomode transducer 20 to 24 are located at the top area 16, namely at a common side of the three-dimensional housing 12, which is assigned to the top of the housing 12. In other words, the second ports 32 to 36 are located in a common plane that is parallel to the base area 14 since the top area 16 is parallel to the base area 14.

Further, the first ports 26 to 30 are orientated perpendicularly with respect to the second ports 32 to 36, as the lateral surface 18 is perpendicular to the top area 16.

With reference to FIG. 2, it becomes obvious that the respective ports 26 to 42 of each orthomode transducer 20 to 24 are assigned to a respective waveguide 44, 46, 48 of the orthomode transducers 20 to 24. The respective waveguides 44 to 48 of the orthomode transducers 20 to 24 do not intersect with each other within the three-dimensional housing 12. Thus, the signals processed by the orthomode transducers 20 to 24 are separated from each other. In other words, the several orthomode transducers 20 to 24 are not connected to a same antenna and, thus, sharing a common signal received, as they are assigned to dedicated antennas used for respective antenna bands.

The specific arrangement can be ensured in an easy manner, as the respective first ports 26 to 30 as well as the third ports 38 to 42 are located in different planes E1 to E3, namely at different heights.

The respective waveguide 44 to 48 of each orthomode transducer 20 to 24 connects the respective first port 26 to 30 with the respective third port 38 to 42 in a straight manner, as the first ports 26 to 30 are located opposite to the third ports 38 to 42.

In addition, the second ports 32 to 36 of each orthomode transducer 20 to 24 are also connected to the respective waveguides 44 to 48.

The waveguides 44 to 48 of each orthomode transducer 20 to 24 are located at different heights with respect to the base area 14. This can be verified easily in a side view on the multi-band orthomode transducer device 10.

Hence, the waveguides 44 to 48 are arranged in the respective planes E1 to E3, in which the respective first ports 26 to 30 as well as the respective third ports 38 to 42 are also located.

Further, each of the orthomode transducers 20 to 24 comprises an antenna 50, 52, 54. The antennas 50 to 54 are connected with the third ports 38 to 42 of the respective orthomode transducers 20 to 24. In the shown embodiments, the antennas 50 to 54 are established as horn antennas.

Accordingly, the third ports 38 to 42 of each orthomode transducer 20 to 24 are shaped circularly, whereas the output ports 26 to 36 are shaped rectangularly.

As the antennas 50 to 54 are connected with the third ports 38 to 42, the antennas 50 to 54 are also located at different heights with respect to the base area 14.

Thus, the multi-band orthomode transducer device 10 comprises an integrated rectangular to circular transition 56 for each orthomode transducer 20 to 24. In other words, three integrated rectangular to circular transitions 56 are provided. For instance, the respective transitions 56 are established by the respective waveguides 44 to 48.

As already indicated in the Figures, each of the orthomode transducers 20 to 24 is assigned to a separate frequency band establishing the multi-band orthomode transducer device 10.

The separate frequency bands processed by the multi-band orthomode transducer device 10 together range from 20 to 90 GHz. Hence, the first orthomode transducer 20 may be assigned to a first frequency band (band 1) that ranges from 20 to 40 GHz, wherein the second orthomode transducer 22 may be assigned to a second frequency band (band 2) that ranges from 40 to 60 GHz, and wherein the third orthomode transducer 24 is assigned to a third frequency band (band 3) that ranges from 60 to 90 GHz.

In operation of the multi-band orthomode transducer device 10, the housing 12 and, thus, the integrated orthomode transducers 20 to 24 may be rotated by a rotary positioner 58 that is assigned to the housing 12, as shown in FIGS. 1 and 2.

As discussed above, the multi-band orthomode transducer device 10 may receive signals via the respective antennas 50 to 54 wherein each of the antenna 50 to 54 is assigned to a certain frequency band, namely the first frequency band, the second frequency band as well as the third frequency band as described above.

The orthomode transducers 20 to 24 split the signals received for each of the separate frequency bands into different polarized signals or rather signal portions, particularly orthogonally polarized signals or rather signal portions, which are forwarded to the respective first and second ports 26 to 36. The first and second ports 26 to 36 may be connected with waveguides for feeding a network assigned to the waveguides.

Alternatively, the network may provide different polarized, particularly orthogonally polarized, signals or rather signal portions, which are fed via the first and second ports 26 to 36. The signals or rather signal portions are forwarded to the orthomode transducers 20 to 24 that combine the signals or rather signal portions to a combined signal outputted via the respective third ports 38 to 42, particularly the antennas 50 to 54 connected with the third ports 38 to 42.

Generally, a multiplexer and/or a switch may be assigned to the multi-band orthomode transducer device 10 such that the respective orthomode transducer 20 to 24 may be activated or deactivated for measuring purposes.

Accordingly, a single-housed multi-band orthomode transducer device 10 is provided that can be used in an easy and efficient manner for measuring high bandwidth, as several orthomode transducers 20 to 24 are integrated in a common three-dimensional housing 12 of the multi-band orthomode transducer 10. The several orthomode transducers 20 to 24 are rotated commonly when the housing 12 is rotated by means of the rotary positioner 58.

In addition, the multi-band orthomode transducer device 10 may be used in a testing system, for instance a Compact Antenna Test Range (CATR) system or rather a Wireless Performance Testing Chamber (WPTC) system. However, the multi-band orthomode transducer device 10 may also be used in far-field testing systems.

The testing system may relate to testing separate frequency bands from 20 to 90 GHz for 5G Frequency Range 2 (FR2) and spurious emissions.

Hence, an over-the-air (OTA) testing system may comprise the multi-band orthomode transducer device 10 for simplifying testing communication devices with regard to wideband signals, as the multi-band orthomode transducer device 10 ensures processing several separate frequency bands.

The invention claimed is:

1. A multi-band orthomode transducer device with a three-dimensional housing, the three-dimensional housing encompassing at least two orthomode transducers, each orthomode transducer being assigned to three ports of which a first port is assigned to a first polarization, a second port is assigned to a second polarization and a third port is assigned to a combination of the first and second polarizations, the orthomode transducers each having a waveguide connected with the three ports, the waveguides of the orthomode transducers being located in the three-dimensional housing without intersecting each other, wherein the three-dimensional housing has a polygonal shape, a cylindrical shape or a spherical shape.

2. The multi-band orthomode transducer device according to claim 1, wherein the first port relates to a first output port, the second port relates to a second output port, and the third port relates to a feed port.

3. The multi-band orthomode transducer device according to claim 1, wherein the first port of each orthomode transducer is opposite to the respective third port.

4. The multi-band orthomode transducer device according to claim 1, wherein the respective first ports are located in different planes being parallel to a base area of the multi-band orthomode transducer device.

5. The multi-band orthomode transducer device according to claim 1, wherein the respective second ports are located at a common side of the three-dimensional housing.

6. The multi-band orthomode transducer device according to claim 1, wherein the respective second ports are located in a common plane being parallel to a base area of the multi-band orthomode transducer device.

7. The multi-band orthomode transducer device according to claim 1, wherein the first ports are perpendicularly orientated with respect to the second ports.

8. The multi-band orthomode transducer device according to claim 1, wherein the first and second ports each are shaped rectangularly.

9. The multi-band orthomode transducer device according to claim 1, wherein the third ports are shaped circularly.

10. The multi-band orthomode transducer device according to claim 1, wherein an integrated rectangular to circular transition is provided.

11. The multi-band orthomode transducer device according to claim 1, wherein the at least two orthomode transducers are assigned to separate frequency bands.

12. The multi-band orthomode transducer device according to claim 11, wherein the separate frequency bands together range from 20 to 90 Ghz.

13. The multi-band orthomode transducer device according to claim 1, wherein at least one of a rotary positioner, a multiplexer and a switch is provided.

14. The multi-band orthomode transducer device according to claim 1, wherein an antenna is connected to each of the third ports.

15. The multi-band orthomode transducer device according to claim 14, wherein the respective antenna is a horn antenna.

16. The multi-band orthomode transducer device according to claim 1, wherein the multi-band orthomode transducer device is single-housed.

17. A multi-band orthomode transducer device with a three-dimensional housing, the three-dimensional housing encompassing at least two orthomode transducers, each orthomode transducer being assigned to three ports of which a first port is assigned to a first polarization, a second port is assigned to a second polarization and a third port is assigned to a combination of the first and second polarizations, the orthomode transducers each having a waveguide connected with the three ports, the waveguides of the orthomode transducers being located in the three-dimensional housing without intersecting each other, wherein the at least two orthomode transducers are assigned to separate frequency bands.

18. A multi-band orthomode transducer device with a three-dimensional housing, the three-dimensional housing encompassing at least two orthomode transducers, each orthomode transducer being assigned to three ports of which a first port is assigned to a first polarization, a second port is assigned to a second polarization and a third port is assigned to a combination of the first and second polarizations, the orthomode transducers each having a waveguide connected with the three ports, the waveguides of the orthomode transducers being located in the three-dimensional housing without intersecting each other, and wherein the respective first ports are located in different planes being parallel to a base area of the multi-band orthomode transducer device or wherein the first ports are perpendicularly orientated with respect to the second ports.

* * * * *